US006520658B2

(12) United States Patent
Chen

(10) Patent No.: US 6,520,658 B2
(45) Date of Patent: Feb. 18, 2003

(54) GLOW IN DARK LIGHTER

(76) Inventor: Peter Chen, 11135 E. Rush St., Suite B, S. El Monte, CA (US) 91733

( * ) Notice: Subject to any disclaimer, the term of this patent is extended or adjusted under 35 U.S.C. 154(b) by 15 days.

(21) Appl. No.: 09/900,648

(22) Filed: Jul. 6, 2001

(65) Prior Publication Data

US 2003/0007351 A1 Jan. 9, 2003

(51) Int. Cl.[7] ..... F21W 131/30; F21V 33/00

(52) U.S. Cl. ..... 362/84; 431/353; 431/255; 362/101; 362/109; 362/253; 362/124; 362/808

(58) Field of Search ..... 362/101, 109, 362/96, 84, 124, 253, 254, 808; 431/353, 252, 255, 125, 126

(56) References Cited

U.S. PATENT DOCUMENTS 1,110,100 A * 9/1914 Ambash et al. ..... 362/124
2,198,234 A * 4/1940 Stratton ..... 431/126
3,205,350 A * 9/1965 Roszkowski et al. ..... 362/124
6,093,016 A * 7/2000 Lin ..... 431/125

* cited by examiner

*Primary Examiner*—Laura K. Tso
(74) *Attorney, Agent, or Firm*—Raymond Y. Chan; David & Raymond Patent Group

(57) ABSTRACT

A glow in dark lighter includes a luminous casing having a receiving cavity for receiving a liquefied gas storage therein and at least a luminous area adapted to be visible in the dark, a gas emitting nozzle disposed in the luminous casing and communicating with the liquefied gas storage for control a flow of gas, and an ignition system comprising an ignition button for igniting the lighter. Therefore, the glow in dark lighter of the present invention is capable self-illuminating in the dark.

20 Claims, 3 Drawing Sheets

GLOW IN DARK LIGHTER

BACKGROUND OF THE PRESENT INVENTION

1. Field of Invention

The present invention relates to a lighter, and more particularly to a glow in dark lighter which is adapted to be self-illuminated in the dark so as to facilitate for a user to look for the lighter especially in a dim condition.

2. Description of Related Arts

Lighters have been know and sold throughout the United States. Almost every smoker is used to carry a lighter for lighting a cigarette or a cigar. However, they always have a common problem when they look for a lighter in the dark. For example, when the user is in a bar in which the light is dim, it is hard to look to the lighter in such dim condition to light a cigarette. Or, when the user is in the bedroom in when the lamp is switched off, it is extremely difficult to find the lighter unless the user impatiently to turn on the lamp. Besides, the user may easily loss his or her lighter in the dark since the lighter has no significant illuminating feature to attract the user's attention.

SUMMARY OF THE PRESENT INVENTION

A main object of the present invention is to provide a glow in dark lighter which is visible in the dark so as to facilitate for a user to look for the lighter especially in a dim condition.

Another object of the present invention is to provide a glow in dark lighter which is adapted to be self-illuminated without using electrical power so as to minimize the cost of the lighter.

Another object of the present invention is to provide a glow in dark lighter, wherein no expensive or complicate mechanical structure is required to employ in the present invention in order to achieve the mentioned objects. Therefore, the present invention successfully provides an economic and efficient solution for attracting users' attention in the dark.

Another object of the present invention is to provide a glow in dark lighter which comprises a signlight arrangement adapted for emitting light when the lighter is ignited, so as to provide an ignition alert of the lighter.

Accordingly, in order to accomplish the above objects, the present invention provides a glow in dark lighter, which comprises a luminous casing having a receiving cavity for receiving a liquefied gas storage therein and at least a luminous area adapted to be visible in the dark, a gas emitting nozzle disposed in the luminous casing and communicating with the liquefied gas storage for control a flow of gas, and an ignition system comprising an ignition button for igniting the lighter. Therefore, the glow in dark lighter of the present invention is capable self-illuminating in the dark.

DETAILED DESCRIPTION OF THE PREFERRED EMBODIMENT

Figure 1:
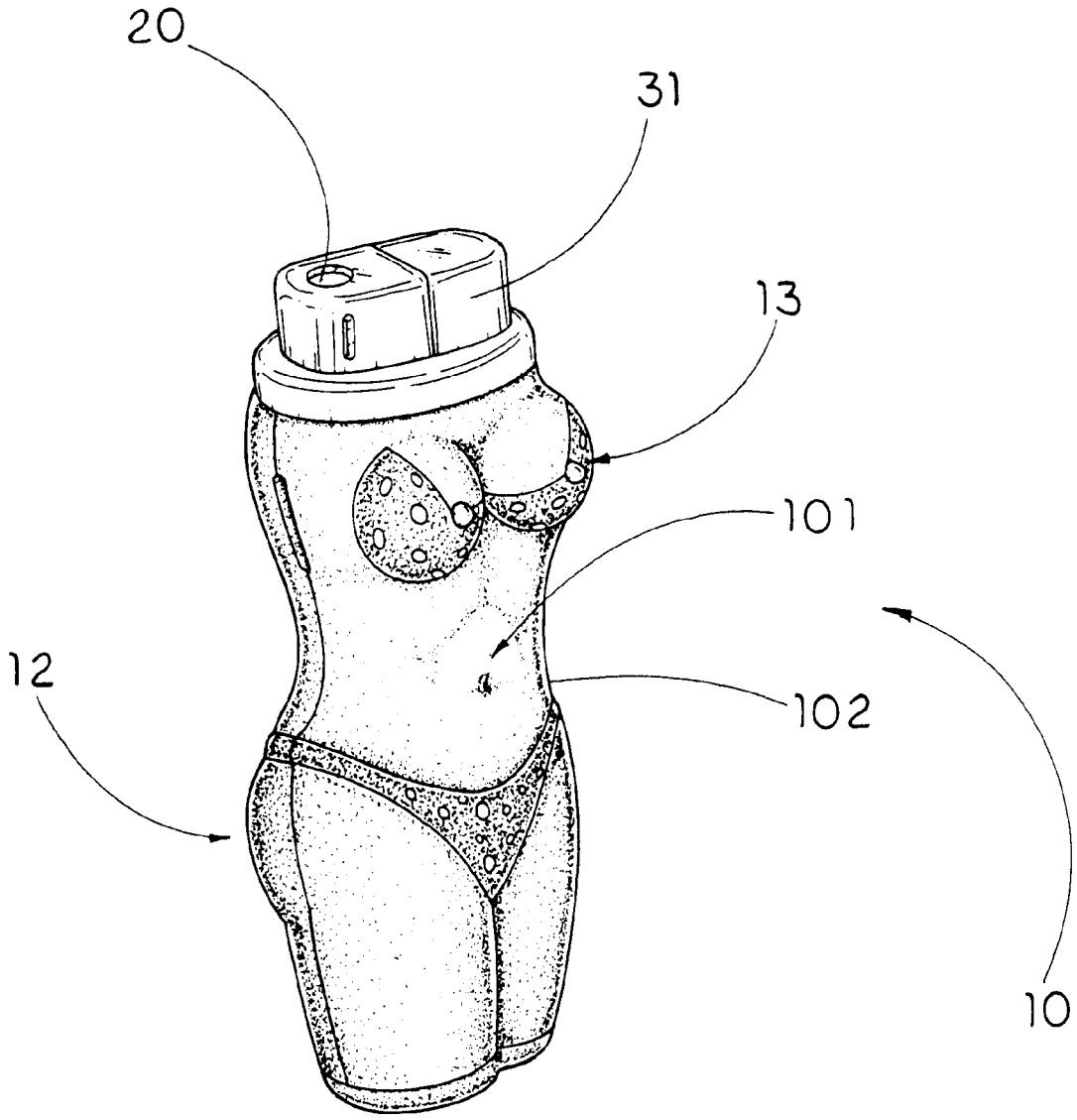
FIG. 1 is a perspective view of a glow in dark lighter according to a preferred embodiment of the present invention.

Referring to FIG. 1 of the drawings, a glow in dark lighter according to a preferred embodiment of the present invention is illustrated, wherein the glow in dark lighter comprises a luminous casing 10, having a receiving cavity 11 for receiving a liquefied gas storage 12 therein and at least a luminous area 101 adapted to be visible in the dark, a gas emitting nozzle 20 disposed in the luminous casing 10 and communicating with the liquefied gas storage 12 for control a flow of gas, and an ignition system 30 comprising a ignition button 31 for igniting the lighter.

The luminous casing 10 has an exterior surface 102 wherein the luminous area 101 is provided thereon such that the luminous casing 10 is capable of self-illuminating in the dark. Moreover, the luminous casing 10 further has at least a through slot 13 provided thereon for communicating the receiving cavity 11 with an exterior of the luminous casing 10.

The ignition system 30, such as a standard piezoelectric lighter, comprises piezoelectric unit 32, which is disposed in the luminous casing 10 for generating piezoelectricity, comprising a movable operating part 321 extended upwardly and an ignition tip 322 extended to a position close to the gas emitting nozzle 20, wherein the movable operating part 321 is depressed downwardly, the ignition tip 322 generates sparks to ignite the gas emitted from the gas emitting nozzle 20 at the same time.

A rear portion of the ignition button 31 is positioned above a top end of the movable operating part 321 of the piezoelectric unit 32 and arranged in such a manner when the ignition button 31 is pushed downwardly, the movable operating part 321 of the piezoelectric unit 32 is depressed to ignite the glow in dark lighter.

According to the preferred embodiment, the luminous casing 10, which is preferably made of plastic, comprises a fluorescent element 12 attached on the exterior surface 102 of the luminous casing 10 to define the luminous area 101 thereof. In other words, the entire exterior surface 102 of the luminous casing 10, which is the luminous area 101 thereof, is capable of self-illuminating in the dark.

The fluorescent element 12, which is preferably a fluorescent paint, is permanently coated on the exterior surface 102 of the luminous casing 10 such that the luminous casing 10 can be visible in the dark. Alternatively, the fluorescent element 12 can be a fluorescent powder attached by adhering to the exterior surface 102 of the luminous casing 10 to achieve the luminosity purpose.

It is worth to mention that a flint type lighter can also be employed the luminous casing 10 such that the flint type lighter can be visible in the dark.

Figure 2:
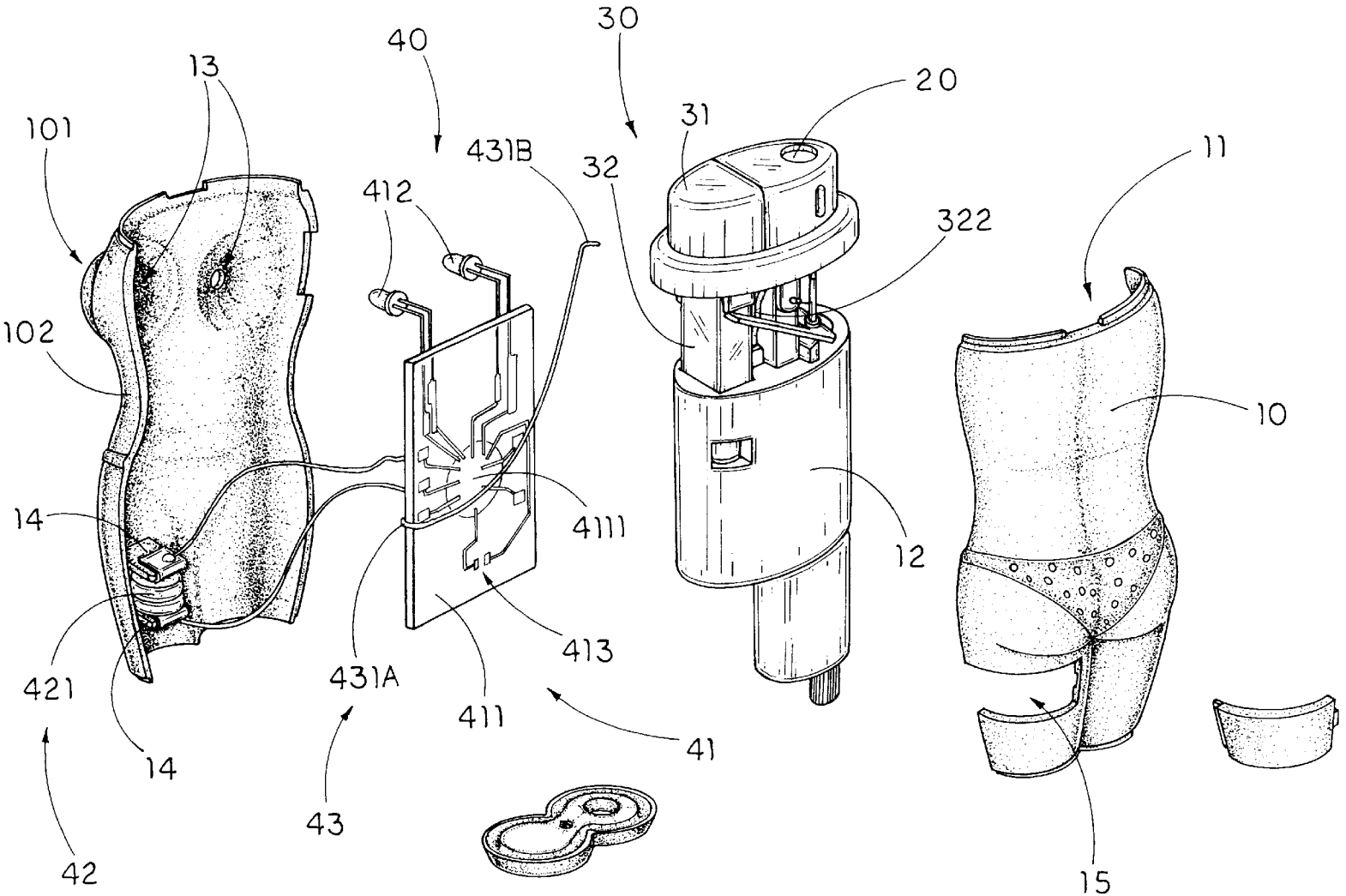
FIG. 2 is an exploded perspective view of the glow in dark lighter according to the above preferred embodiment of the present invention.
Figure 3:
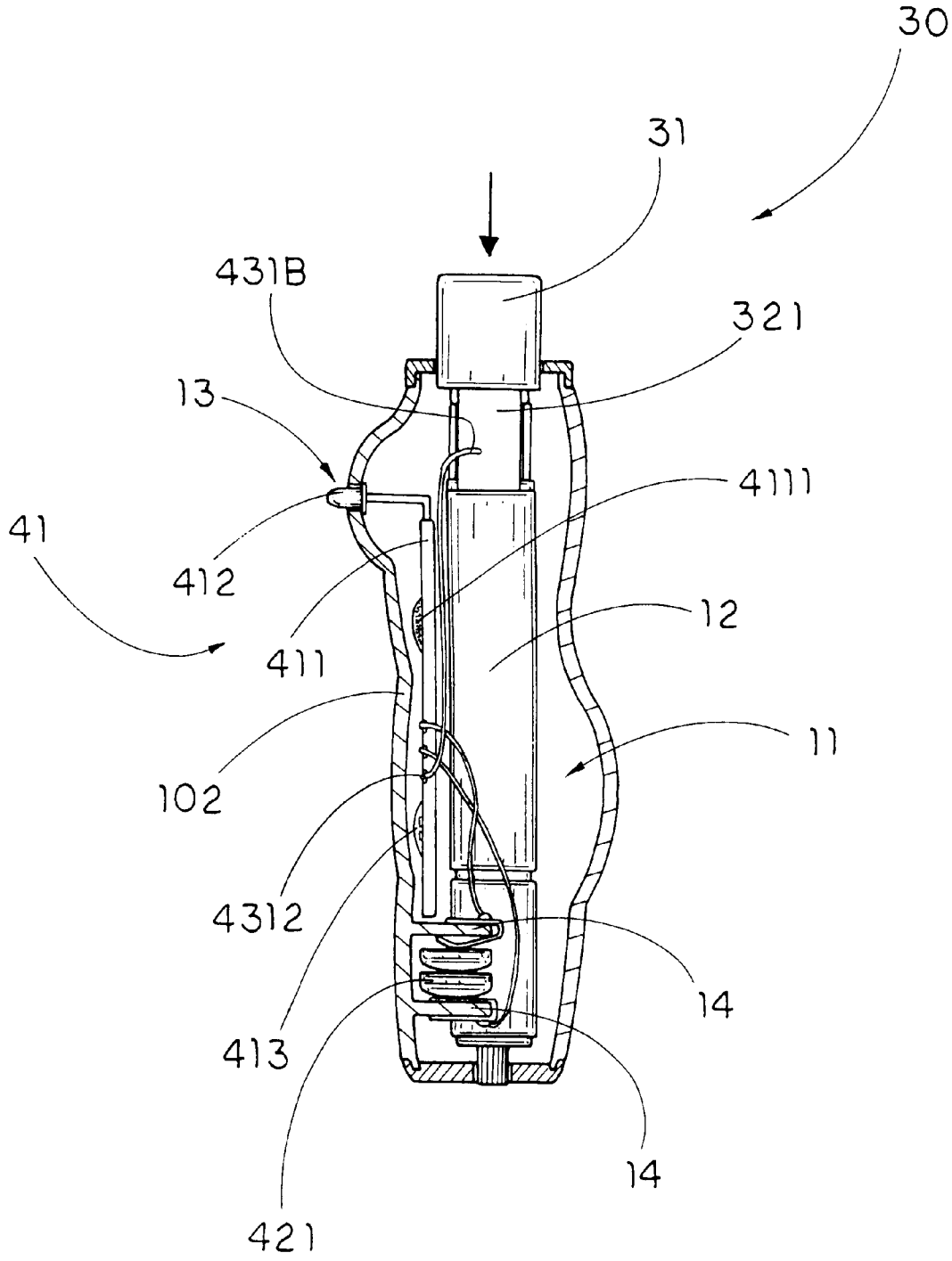
FIG. 3 is a partially sectional view of the glow in dark lighter according to the above preferred embodiment of the present invention.

As shown in FIG. 2, the glow in dark lighter further comprises a signlight arrangement 40 disposed in the receiving cavity 11 for illuminating light when the glow in dark lighter is ignited. The signlight arrangement 40 comprises an illuminator 41, a power supply 42 electrically connected to the illuminator 41, and a motion switch 43 electrically extended from the illuminator 41 and arranged to detect a motion of the ignition button 31 so as to emitting light from the illuminator 412. Therefore, the emitting light from the illuminator 41 can be seen when the glow in dark lighter is ignited.

The motion switch 43 comprises a conductive wire 431 having a connecting end 431*a* electrically connected to the illuminator 41 and a detecting end 431*b* extended to a position close to the ignition button 31 for detecting the downward motion of the ignition button 31.

According to the preferred embodiment, the illuminator 41 comprises an IC board 411 and at least a LED 412 electrically mounted thereon wherein a head portion of the LED 412 is extended to the exterior of the luminous casing 10 through the through slot 13. As shown in FIGS. 1 and 2, there are two LEDs 412 mounted the IC board 411 and passing through two through slots 13 respectively so as to extend to the exterior of the luminous casing 10.

The illuminator 41 further comprises an illuminating unit 413 electrically provided on the IC board 411 in such a manner that when the illuminator 41 is switched on, the light from the illuminating unit 413 is adapted for passing through the luminous casing 10 to the exterior thereof.

The IC board 411 comprises a control means 4111 for orderly controlling the lights from the LED 412 and the illuminating unit 413 in a cycle manner. In other words, when the illuminator 41 is switched on, both the LED 412 and the illuminating unit 413 emit lights orderly in predetermined cycles.

The power supply 42 comprises at least a replaceable battery 421 securely disposed in the receiving cavity 11 of the luminous casing 10 wherein the replaceable battery 421 is electrically connected to the IC board 411 via a pair of wires. In order to hold the replaceable battery 421 in the luminous casing 10, the luminous casing 10 further comprises a pair of parallel holding members 14 inwardly and integrally protruded from the luminous casing 10 and an opening 15 is formed on a rear side of the luminous casing 10 in such a manner that the replaceable battery 421 is securely mounted between the two holding members 14 and adapted to be replaced through the opening 15 of the luminous casing 10 without disassembling the glow in dark lighter.

It is worth to mention that the signlight arrangement 40 can be incorporated the slide-down type piezoelectric lighter wherein the ignition button is depressed downwardly and sidewardly to ignite the piezoelectric lighter. In other words, the motion switch 43 of the signlight arrangement 40 can detect not only the downward motion of the ignition button 31 but also the slid-down motion of the ignition button.

What is claimed is:

1. A glow in dark lighter, comprising:

a luminous casing having a receiving cavity for receiving a liquefied gas storage therein and at least a luminous area adapted to be visible in the dark;

a gas emitting nozzle disposed in said luminous casing and communicating with said liquefied gas storage for control a flow of gas; and an ignition system comprising an ignition button for igniting said lighter.

2. A glow in dark lighter, as recited in claim 1, wherein said casing comprises a fluorescent element attached on an exterior surface of said luminous casing to define said luminous area thereof such that said exterior surface of said luminous casing is capable of self-illuminating in the dark.

3. A glow in dark lighter, as recited in claim 2, wherein said fluorescent element is a fluorescent paint permanently coated on said exterior surface of said luminous casing.

4. A glow in dark lighter, as recited in claim 1, wherein said ignition system further comprises a piezoelectric unit, which is disposed in said luminous casing for generating piezoelectricity, comprising a movable operating part extended upwardly and an ignition tip extended to a position close to said gas emitting nozzle, wherein said movable operating part is depressed downwardly, said ignition tip generates sparks to ignite said gas emitted from said gas emitting nozzle at the same time, a rear portion of said ignition button being positioned above a top end of said movable operating part of said piezoelectric unit and arranged in such a manner when said ignition button is pushed downwardly, said movable operating part of said piezoelectric unit is depressed to ignite said glow in dark lighter.

5. A glow in dark lighter, as recited in claim 2, wherein said ignition system further comprises a piezoelectric unit, which is disposed in said luminous casing for generating piezoelectricity, comprising a movable operating part extended upwardly and an ignition tip extended to a position close to said gas emitting nozzle, wherein said movable operating part is depressed downwardly, said ignition tip generates sparks to ignite said gas emitted from said gas emitting nozzle at the same time, a rear portion of said ignition button being positioned above a top end of said movable operating part of said piezoelectric unit and arranged in such a manner when said ignition button is pushed downwardly, said movable operating part of said piezoelectric unit is depressed to ignite said glow in dark lighter.

6. A glow in dark lighter, as recited in claim 1, further comprising a signlight arrangement disposed in said receiving cavity for illuminating light when said glow in dark lighter is ignited, wherein said signlight arrangement comprises an illuminator, a power supply electrically connected to said illuminator, and a motion switch electrically extended from said illuminator and arranged to detect a motion of said ignition button so as to emitting light from said illuminator.

7. A glow in dark lighter, as recited in claim 6, wherein said motion switch comprises a conductive wire having a connecting end electrically connected to said illuminator and a detecting end extended to a position close to said ignition button for detecting said motion thereof.

8. A glow in dark lighter, as recited in claim 6, wherein said illuminator comprises an IC board, at least a LED electrically mounted thereon, and an illuminating unit electrically provided on said IC board wherein said IC board comprises a control means for orderly controlling lights emitted from said LED and said illuminating unit respectively in predetermined cycles when said illuminator is switched on.

9. A glow in dark lighter, as recited in claim 7, wherein said illuminator comprises an IC board, at least a LED electrically mounted thereon, and an illuminating unit electrically provided on said IC board wherein said IC board comprises a control means for orderly controlling lights emitted from said LED and said illuminating unit respectively in predetermined cycles when said illuminator is switched on.

10. A glow in dark lighter, as recited in claim 9, wherein said luminous casing further comprises a pair of parallel holding members inwardly and integrally protruded from said luminous casing and an opening formed on a rear side of said luminous casing in such a manner that said power supply which comprises at least a replaceable battery is securely mounted between said two holding members and adapted to be replaced through said opening of said luminous casing.

11. A glow in dark lighter, as recited in claim 2, further comprising a signlight arrangement disposed in said receiving cavity for illuminating light when said glow in dark lighter is ignited, wherein said signlight arrangement comprises an illuminator, a power supply electrically connected to said illuminator, and a motion switch electrically extended from said illuminator and arranged to detect a motion of said ignition button so as to emitting light from said illuminator.

12. A glow in dark lighter, as recited in claim 11, wherein said motion switch comprises a conductive wire having a connecting end electrically connected to said illuminator and a detecting end extended to a position close to said ignition button for detecting said motion thereof.

13. A glow in dark lighter, as recited in claim 11, wherein said illuminator comprises an IC board, at least a LED electrically mounted thereon, and an illuminating unit electrically provided on said IC board wherein said IC board comprises a control means for orderly controlling lights emitted from said LED and said illuminating unit respectively in predetermined cycles when said illuminator is switched on.

14. A glow in dark lighter, as recited in claim 12, wherein said illuminator comprises an IC board, at least a LED electrically mounted thereon, and an illuminating unit electrically provided on said IC board wherein said IC board comprises a control means for orderly controlling lights emitted from said LED and said illuminating unit respectively in predetermined cycles when said illuminator is switched on.

15. A glow in dark lighter, as recited in claim 14, wherein said luminous casing further comprises a pair of parallel holding members inwardly and integrally protruded from said luminous casing and an opening formed on a rear side of said luminous casing in such a manner that said power supply which comprises at least a replaceable battery is securely mounted between said two holding members and adapted to be replaced through said opening of said luminous casing.

16. A glow in dark lighter, as recited in claim 5, further comprising a signlight arrangement disposed in said receiving cavity for illuminating light when said glow in dark lighter is ignited, wherein said signlight arrangement comprises an illuminator, a power supply electrically connected to said illuminator, and a motion switch electrically extended from said illuminator and arranged to detect a motion of said ignition button so as to emitting light from said illuminator.

17. A glow in dark lighter, as recited in claim 16, wherein said motion switch comprises a conductive wire having a connecting end electrically connected to said illuminator and a detecting end extended to a position close to said ignition button for detecting said motion thereof.

18. A glow in dark lighter, as recited in claim 16, wherein said illuminator comprises an IC board, at least a LED electrically mounted thereon, and an illuminating unit electrically provided on said IC board wherein said IC board comprises a control means for orderly controlling lights emitted from said LED and said illuminating unit respectively in predetermined cycles when said illuminator is switched on.

19. A glow in dark lighter, as recited in claim 17, wherein said illuminator comprises an IC board, at least a LED electrically mounted thereon, and an illuminating unit electrically provided on said IC board wherein said IC board comprises a control means for orderly controlling lights emitted from said LED and said illuminating unit respectively in predetermined cycles when said illuminator is switched on.

20. A glow in dark lighter, as recited in claim 19, wherein said luminous casing further comprises a pair of parallel holding members inwardly and integrally protruded from said luminous casing and an opening formed on a rear side of said luminous casing in such a manner that said power supply which comprises at least a replaceable battery is securely mounted between said two holding members and adapted to be replaced through said opening of said luminous casing.

* * * * *